US005156682A

United States Patent [19]

Zimmer

[11] Patent Number: 5,156,682

[45] Date of Patent: Oct. 20, 1992

[54] PRESSING DEVICE FOR DOCTOR HAVING SEGMENTS LINKED TOGETHER

[76] Inventor: Johannes Zimmer, Ebentaler Strasse 133, 9020 Klagenfurt, Austria

[21] Appl. No.: 469,562

[22] PCT Filed: May 18, 1988

[86] PCT No.: PCT/EP88/00434

§ 371 Date: Apr. 9, 1990

§ 102(e) Date: Apr. 9, 1990

[87] PCT Pub. No.: WO89/03259

PCT Pub. Date: Apr. 20, 1989

[30] Foreign Application Priority Data

| | | | |
|---|---|---|---|
| Oct. 10, 1987 | [EP] | European Pat. Off. | 87730126.7 |
| Oct. 10, 1987 | [EP] | European Pat. Off. | 87730128.3 |
| Oct. 10, 1987 | [DE] | Fed. Rep. of Germany | 3734747 |
| Oct. 10, 1987 | [DE] | Fed. Rep. of Germany | 8713788[U] |
| Oct. 10, 1987 | [DE] | Fed. Rep. of Germany | 8713789[U] |

[51] Int. Cl.[5] ..... B05C 11/04

[52] U.S. Cl. ..... 118/119; 101/119; 118/122; 118/126; 118/406; 118/413; 118/414

[58] Field of Search ..... 118/213, 110, 117, 118, 118/119, 122, 126, 406, 413, 414, 419; 101/119, 120

[56] References Cited

U.S. PATENT DOCUMENTS

| | | | |
|---|---|---|---|
| 2,109,336 | 2/1938 | Marsden | 101/119 X |
| 3,182,632 | 5/1965 | Vazdikis | 118/126 X |
| 3,216,349 | 11/1965 | Kraft | 118/119 X |
| 3,592,132 | 7/1971 | Weber | 101/119 |
| 3,930,445 | 1/1976 | Jaffa | 101/120 |
| 4,031,823 | 6/1977 | McGee | 101/120 |
| 4,638,733 | 1/1987 | Schneider et al. | 101/119 X |
| 4,665,723 | 5/1987 | Zimmer | 118/674 X |
| 4,732,776 | 3/1988 | Boissevain | 118/413 X |

FOREIGN PATENT DOCUMENTS 2250092 4/1974 Fed. Rep. of Germany .

*Primary Examiner*—Michael G. Wityshyn

*Attorney, Agent, or Firm*—Fay, Sharpe, Beall, Fagan, Minnich & McKee

[57] ABSTRACT

A doctor for applying material, having a pressing part (doctor body) bending elasticly in the longitudinal direction and corresponding to the application width and a row of segments for pressing the pressing part, the segments (20) are connected in link-like manner by web or holding parts (203, 29, 39, 4, 40 to 48) to a unit-forming pressing device (2) pressing at least one pressing part (3, 30, 31, 32, 36), and the segments (20) being held independently to the pressing part (3, 30, 31, 32, 36).

30 Claims, 5 Drawing Sheets

FIG. 1
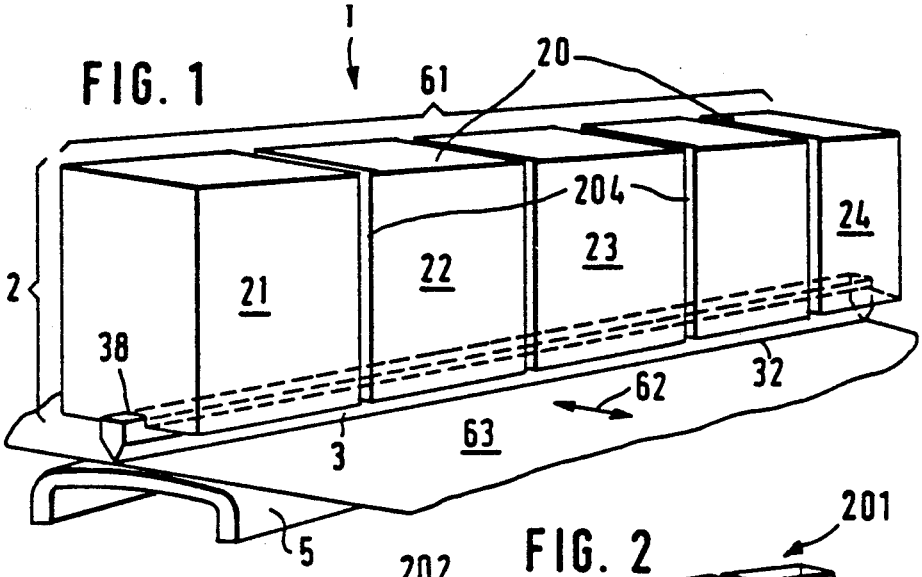
FIG. 2
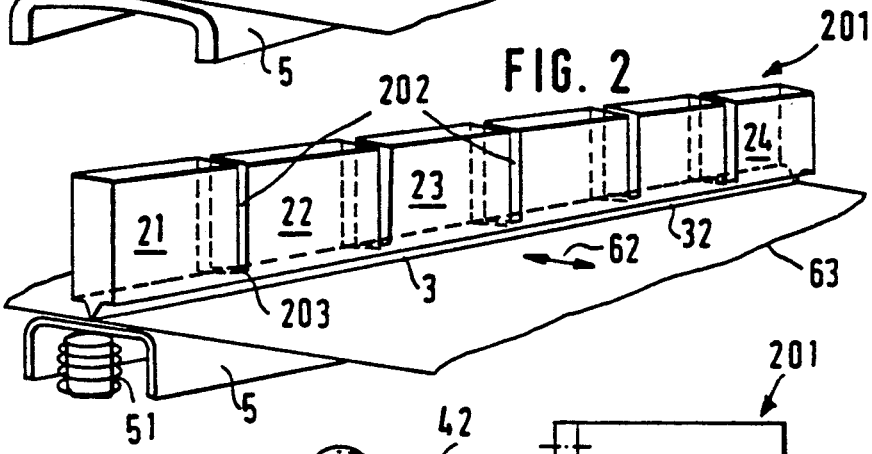
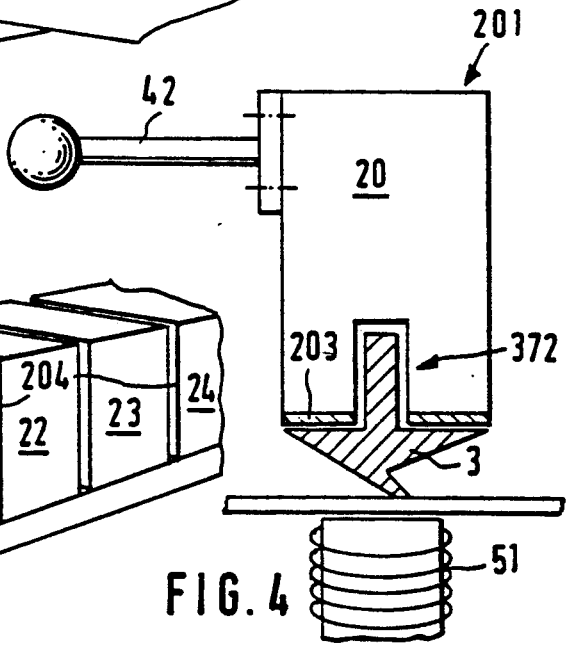
FIG. 3
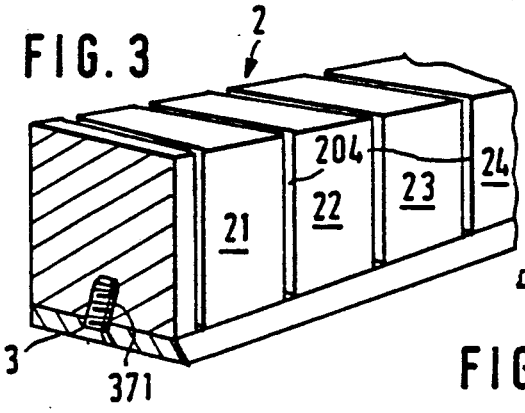
FIG. 4

PRESSING DEVICE FOR DOCTOR HAVING SEGMENTS LINKED TOGETHER

BACKGROUND OF THE INVENTION

The invention relates to an apparatus for applying fluent material such as optionally foamable substances of differing viscosity, coating substances, varnishes, adhesives, pastes, etc. to a substrate, such as a web of material with at least one pressing part in the length of the apparatus (application width) for engaging in a substrate path and with a pressing device for operating the pressing part. Such an application apparatus is used in machines for flat stencil printing, round stencil applications and/or devices for stencil-free, full-surface applications, in which the application width or extension of the pressing part can be several meters. As a function of the sphere of use it is possible to make patterning applications (printing) and/or full-surface applications (e.g. impregnation, coating, dyeing and varnishing).

Conventional solid doctor or squeegee strips (pressing parts) with a length of several meters, due to the necessary inherent rigidity, have a considerable curvature over the application width, which is prejudicial to the desired straightness of a doctor strip for engaging on a substrate, such as a material web. Mechanical pressing of such a doctor strip requires complicated doctor mounting supports with which pressing forces are exerted on the ends of the doctor strip, which leads to considerable mechanical expenditure and very solid and robust mounting supports. In addition, the fixing of the doctor strip between the mounting supports leads to an undesired sag over the application width which, like the curvature as a result of inherent stability, can only be counteracted by strengthening the mechanical, lateral pressing. It is also known to magnetically press against a magnetic beam or bar arranged below the material web solid, magnetizable material strips and coating or roll doctors. Either a steel doctor or squeegee device is pressed against the material web (DE-AS 1 135 856) or a magnetizable bar is placed on the back of a sheet or blade-like spreading doctor and presses the latter against the material web (Swiss patent 571 952, DE-OS 34 19 590). The main disadvantages of the known magnetic doctor pressing devices are the dependence of the pressing force on the magnetizable mass or the cross-section of the doctor strip and the distance between the magnetic force-producing and magnetizable means. The doctor must be made for magnetizable material, or must be connected to a longitudinally extending, magnetizable material strip. The bending or curvature of such doctor strips due to inherent rigidity is relatively large not only in use, but at the time of manufacture. Rolled or drawn steel profiles are characterized by strong tensional forces, which are released by machining and/or stressing and lead to a considerable curvature of the profile, which is unsuitable for a linear doctor pressing over several meters. Therefore solid doctors or squeegee devices with complicated mounting supports for mechanical pressing can scarcely be replaced by magnetizable coating profiles pressable by a magnetic force, apart from the use of magnetically pressable squeegee devices in textile stencil printing, but which use has been restricted to relatively small application widths and relatively small magnetizing masses of the squeegee device.

SUMMARY OF THE INVENTION

The problem of the present invention is to provide an application apparatus with a relatively simple construction with which, substantially independently of the magnitude of the pressing force chosen and also over large application widths of several meters and for the most varied width-uniform applications and in particular for very viscous substances, leads to a substantially bending and deformation-free engagement of the pressing element with respect to the substrate, even with relatively small pressing forces.

In conjunction with the features of the aforementioned application apparatus, this problem is solved in that the application apparatus is lengthwise subdivided into segments forming the pressing device, which are lined up in link-like manner and over its length the pressing part is arranged and constructed in bending elastic manner on at least one segment located on the side of the substrate path, the pressing part being subject to the weight and/or magnetic force of all the segments. The invention is particularly characterized in that, whilst avoiding the inherent rigidity of conventional elements extending over several meters, a pressing device is obtained which, with the desired and in particular with a very large mass acting for the pressing force or with a correspondingly large cross-section has no disadvantageous deformation over the application width. The segmental structure of the pressing device ensures over the entire application width, i.e. in the longitudinal direction thereof a bending-slack characteristic which, particularly with relatively large masses or cross-sections, ensures an excellent adaptation and matching of the segmented pressing device to the pressing part arranged thereon and subject to the action thereof on the substrate-carrying or guiding stop member or base. The mass or cross-section of the pressing part is relatively small compared with the corresponding dimensions of the pressing device. The pressing part is made from bending elastic material which, even under the action of relatively small pressing forces, adapts closely to the substrate or support member. A very important advantage is that the pressing part can be manufactured in distortion-free manner in the form of a small cross-section strip, a spreading blade or a thin spreading rod with a random desired spreading profile and is placed on the pressing device. Another very important advantage is that the pressing part is interchangeable and/or following wear to a pressing/doctor edge that can be machined in distortion-free manner, e.g. by appropriate after-grinding. The pressing/doctor profiles can not only be of bending-adaptable metallic material, but e.g. also plastic, glass, ceramic material or a compound material thereof. In the length of the device a width/transverse-flexible application apparatus is obtained which, in the case of simple manufacture, also ensures for large application widths very satisfactory application results for a wide range of pressing forces and particularly for relatively small pressing forces. The application apparatus, in combination with its component parts, has over the working width a very adaptable or desired material-elastic characteristic, its bending resistance compared with the pressing forces being relatively small. Thus, the cross-sections of the pressing part and the pressing device, the total modulus of elasticity in the longitudinal direction and the working width are favourably matched to one another. There is no function-disturbing inherent rigidity of the elements.

The invention is particularly important when constructing the segments in the form of magnetizable parts or electromagnets and/or permanent magnets, which can be detected by magnetic force by a magnetic or magnetizable countermember located on the substrate path. Due to the inventive design of the application apparatus, compared with conventional squeegee devices, the dependence of the pressing force on an optionally magnetizable mass of the squeegee device, material rigidities and/or the distance between the magnetic force-producing and magnetizable parts is eliminated, so that extremely energy-saving operation takes place. In addition, segmentation ensures that magnetic devices can be used in apparatuses with relatively large application widths and for the most varied applications using all the advantages of magnetic pressing.

A particular construction of the invention involves the segments being superimposed in the direction at right angles to the application width and that one pressing part is placed on the segment located towards the side of the substrate path. The segments are in particular constructed as thin, loosely superimposed, bending elastic bars in the longitudinal direction of the apparatus and whose number is a function of the maximum desired pressing force. As a result of the wide, lameller bar arrangement the pressing device has in the longitudinal direction the desired bending slackness or bending elasticity.

According to a further development of the invention the segments are juxtaposed along the application width. A gap is formed between adjacent segments in the longitudinal direction, so that each segment forms a relatively short unit, by means of which pressing force is applied to the bending elastic pressing part. It is particularly advantageous to hold each segment in a bearing in which it is at least slightly movable transverse to the substrate path and also optionally along the latter. Such a bearing can be obtained in a very simple manner by means of a swivel bearing embraced by the application apparatus and/or a clearance fit for the segment, the swivel bearing or clearance fit being placeable both on the pressing part and on a holder for the same, which optionally articulates it in swivellable manner.

The longitudinal segmentation of the apparatus comprises the segments being located along a profile strip in one piece, the said strip being provided in comb-like manner with notches or slots. The notch or slot-free, segment-carrying web profile forms on the pressing device side facing the substrate path a relatively thin, rod-like or plate-like bending elastic part extending over the application width. On the latter can engage a bending elastic pressing part, or the latter can at least partly be connected to the web. According to another construction the web profile is itself constructed as a bending elastic pressing or doctor part over the application width.

The juxtaposed segments in the longitudinal direction of the apparatus can very appropriately be provided as one-piece bodies. According to a development of the invention each segment body is movably arranged with respect to a coating profile accompanied by a loose application or engagement thereon, said profile being constructed as a pressing part. The segments are held against the spreading profile with a swivel bearing and/or with a clearance fit loose bearing arranged on the spreading profile or on a spreading profile holder.

Between the segment or segments on the side of the substrate path and the pressing part, appropriately a bending elastic strip is arranged over the application width and together with the pressing part forms an elastically adaptable combination component over the longitudinal direction of the apparatus.

A bending elastic pressing part extending over the application width in the form of e.g. a blade or round profile doctor can be very simply connected with a flexible predoctor or dosing doctor over the application width. The said doctor parts can be constructed in one piece or in two pieces. In each case, over the application width there is a combined bending elastic working element performing predoctoring/dosing doctoring and doctoring and which as a result of its bending-slack and adapting characteristic ensures a uniform width application result.

For the embodiments of the invention with a fixed engagement of the segments on the pressing part, the latter or a bending elastic intermediate strip and/or a bending elastic predoctor/dosing doctor strip can be very simply connected to the segments by clamping, groove and tongue, plug-in or screw connection.

The segmental pressing device according to the invention is universally usable in machines for the most varied application types or printing press types. It is in particular pointed out that the pressing device is not only suitable for machines with horizontal substrate webs, but also for those with upwardly and/or downwardly guided webs in constructions with magnetic pressing. As required, they make it possible to carry out stencilfree applications and stencil applicatons. It is particularly advantageous to combine two pressing devices according to the invention in an application apparatus for two-sided applications to a substrate web, the application process taking place by substance-applying or scraping squeegee devices.

A particularly appropriate application apparatus according to the invention is characterized in that the pressing device longitudinally (application width) comprises lined-up segments, which can be in the form of independent, relatively short bodies of a magnetic beam, which are in each case pivotably mounted. The application apparatus comprises a magnetizable stop member or base, such as a steel table or roller, against which the segmented magnetic beam forming the pressing device can be moved in element manner, so that the pressing part or parts can be engaged therewith.

According to another embodiment in the extension direction of the segmental magnetic beam there is provided a recess formed by parallel pressing parts that forms a gap for an air knife place on the magnetizable countermember and engaging therein.

Application apparatuses according to the invention with identical pressing devices constructed in mirror image to the substrate path lead to very simple application apparatuses carrying out two-sided applications.

BRIEF DESCRIPTION OF THE DRAWINGS

Further advantages, constructions and developments of the invention can be gathered from the subclaims and the attached diagrammatic drawings. In the drawings:

FIGS. 1 to 3 are respective views of application apparatuses according to the invention with segments lined up along the application width.

FIGS. 4 and 5 are cross-sectional views taken in a plane between adjacent segments in the application width of the application apparatuses according to the invention.

DETAILED DESCRIPTION

Figure 9:
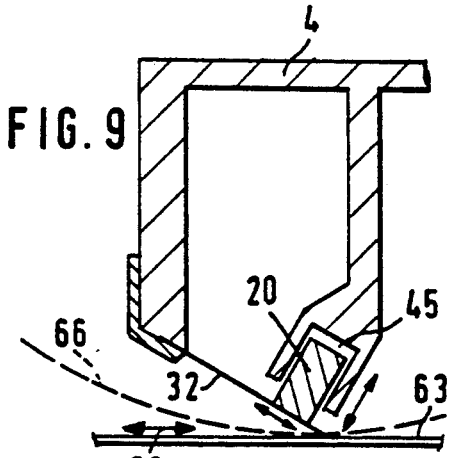
FIGS. 7 to 9 are cross-sectional views of the mounting of individual juxtaposed segments in the application width of the application apparatuses according to the invention.
Figure 15:
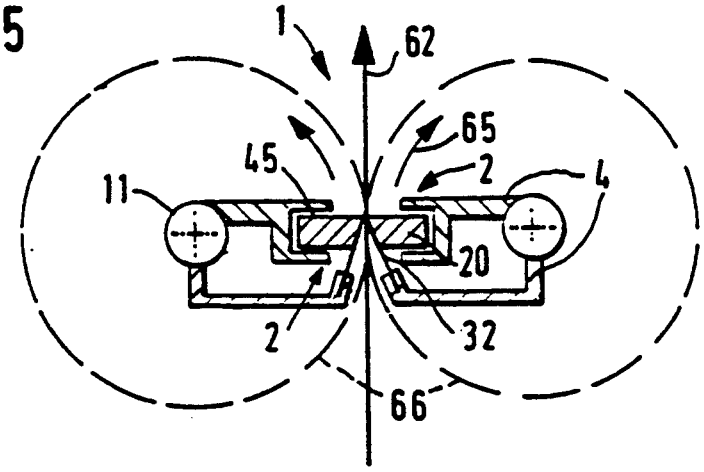
Figure 17:
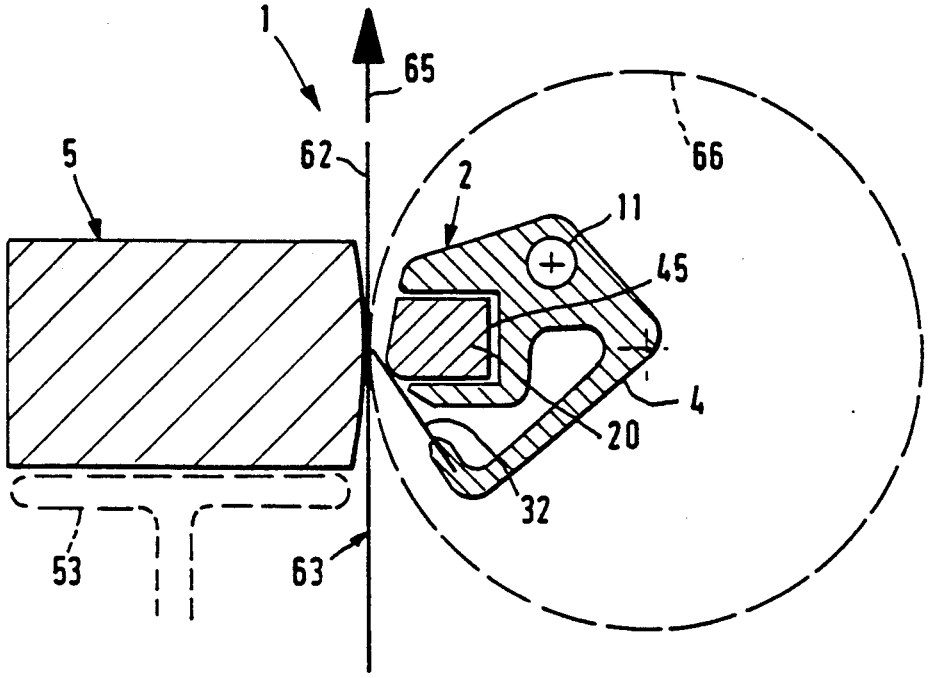
FIG. 17 is a cross-sectional view of an application apparatus according to the invention with segments loosely arranged on a blade coating doctor.

The drawings show only the essential parts of an application apparatus 1 or pressing device 2 according to the invention. Each pressing device 2 is constructed with segments 20 and can be arranged on a substrate path 62, in which is located or guided a substrate, such as a material web 63 to be printed, optionally using a printing blanket. Each pressing part 3 arranaged on one or more segments 20 or 21 to 24 associated with the substrate path and which is constructed in the form of a bending-slack (bending-elastic) doctor or squeegee device extending over the application width 61, is provided in order to form between it and the substrate path a doctor or application gap. Between the pressing part 3 and the substrate 63 can be provided a stencil, such as e.g. a round stencil 66, as indicated in FIGS. 9, 15 and 17, which permits the application to a material web 63 of a substance 67 upstream of a pressing line in the running direction 62 by means of its pattern.

The embodiments relate to application apparatuses 1 with pressing devices 2, which press the pressing part 3 (squeegee device) under the action of magnetic force against the substrate 63 or a countermember 5 guiding the latter. It is clear that e.g. in application apparatuses 1 with horizontally guided substrate webs and with pressing devices 2 positioned above the same, the segments 20 can be constructed as mass elements attractable under gravity.

An apparatus 1 according to FIG. 1 comprises a multipart pressing device 2, which is subdivided over the application width 61 into one-piece bodies 21 to 24 forming segments 20. Between the adjacent segment bodies, e.g. 21, 22 are located gap spaces or surfaces 204. A coating doctor 32 forming the pressing part 3 is constructed as a thin, bending elastic rod and extends over the entire application width 61 of the apparatus. As a spring element the doctor 32 is inserted in grooves 38 on the sides of the segment bodies 21, 22 facing the substrate path 62.

The segments bodies 21 to 24 in FIG. 2 are made from magnetizable material, so that by means of a magnetic beam 51 they are magnetically attractable with respect thereto. It can be seen that the volume, the effective magnetic mass or the cross-section of each individual body determines the maximum size of the magnetic attraction. Although the magnetic mass over the application width 61 can be relatively high, as a result of its link-like structuring, the pressing device 2 bends elastically and is length-adaptable. The volume or the cross-section of the squeegee devices 32 only has a fraction of the corresponding sizes of the segment bodies 21 to 24. Thus, the application apparatus 1 comprising the pressing device 2 and the squeegee devices 32 bends elastically and is adaptable over the entire application width 61. The pressing part 3 can have the most varied doctor profiles and as a rod-like, thin part it can be manufactured in a relatively lightweight, deformation-free manner. It is also very easy to grind in or after-grind such profiles.

The segmentation of the pressing device 2 explained relative to FIG. 1 with relatively large masses brings about the pressing action and combined with the pressing part 3 extend over the application width 61. It has a relatively small cross-section and bends elastically for adaptability purposes constituting an important feature of the invention, set forth with respect to the following embodiments.

In the embodiment according to FIG. 2, juxtaposed segments 21 to 24 over the application width are constructed as parts of a one-piece profile strip 201. The segments 21 to 24 are formed by comb-like incisions, recesses or slots 202 and are held in one piece on a web profile 203. The cross-section of web profile 203 is small compared with the cross-sections of the segments 21 to 24. A coating edge of doctor 32 forming the pressing part 3 is also constructed on the web 203. The profile strip 201 is at least partly made from magnetizable material, so that it can be magnetically biased by a magnetic beam 51 extending in the application width.

Figure 5:
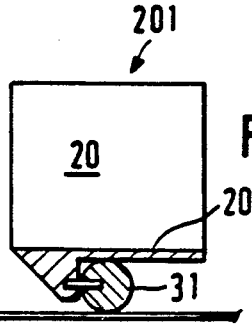

FIG. 5 shows a profile strip 201 having segments 20 and a bending elastic web or strip profile 203, on which is located, e.g. by plug-in connection, a flexible round doctor or squeegee device 31.

Both in the case of a one-piece profile strip 201 with web 203 and in the case of a multipiece pressing device 2, the pressing part 3, which can be profiled e.g. in round or wedge-shaped manner accompanied by the formation of a doctor edge, can be connected by a screw or plug-in connection 371 or 372 to the individual segments 20. Such arrangments of the pressing part 3 are e.g. shown in FIGS. 3 and 4.

As is not shown in detail in FIGS. 1 to 3 and 5, the application apparatus 1 comprises a holder, in which is held in movable manner at right angles to the countermember 5 the pressing device 2 comprising the segments 20. It is particularly appropriate to suspend each of the segments 21 to 24 in a swinging manner, or to provide a pivoting articulation by means of a swivel arm 42 arranged in fixed manner on a segment 20, as shown in FIG. 4.

Figure 6:
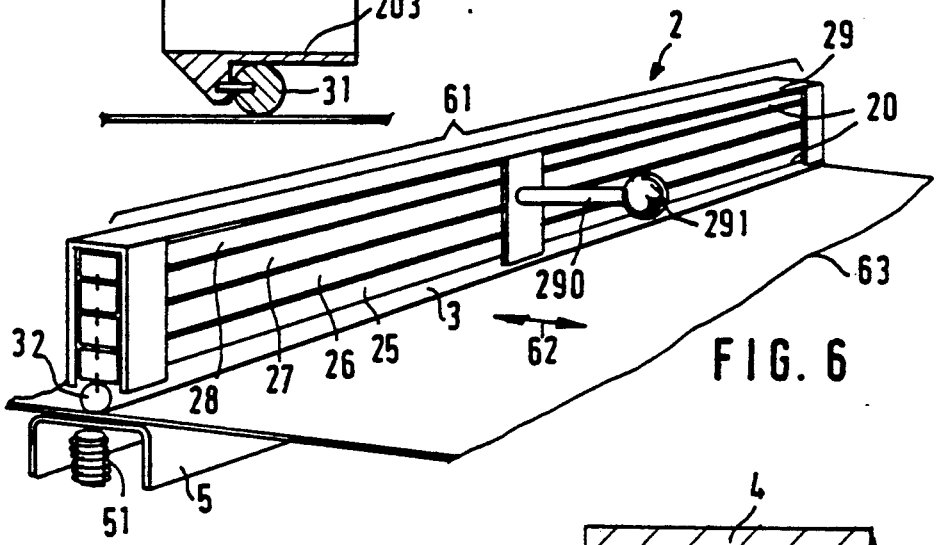
FIG. 6 is a perspective view of an application apparatus according to the invention with segments superimposed in a direction transverse to the applicaton width.

A particular construction of the pressing device 2 according to the invention, as shown in FIG. 6, comprises the segments 25 to 28 forming said device 2 being superimposed transversely to the application width 61. These segments 25 to 28 are made from relatively thin bending elastic strips extending longitudinally of the device. They can be terminally interconnected in chain-like manner by plug-in elements, such as pins. A pressing part 3 in the form of a round squeegee device 32 is located on the segment 25 nearest to the side of the substrate path 62 and is at least terminally held by means of a plug-in connection. The segments 25 to 28 in engagement over their length are movably held in a cage-like frame 29 transversely to the substrate path 62 or to a magnetic beam 51 forming the countermember 5. It is particularly advantageous for the frame 29 to be mounted within the application apparatus so as to be pivotable about an axis parallel to its longitudinal axis, so as to engage the round squeegee device 32 along different pressing lines. For this purpose a swivel arm 290 is provided centrally of the application width on the frame 29. By means of a ball articulation 291 on arm 290, it is ensured that the pressing device 2 with the doctor 3 can be tilted out of a longitudinal position parallel to the substrate path 62, so as to permit very easy adaptation to possibly slightly inclined webs over the application width. In place of the mounting with the frame 29, it is also possible to have a Venetian blind-like arrangement and suspension of the segments 25 to 28.

In the application apparatuses 1 according to the invention with plate or blade-like bending elastic spreading doctors 32 as pressing parts 3, it is particularly advantageous to construct the juxtaposed segments 20 over the application width as one-piece bodies and to arrange same in loosely and independently movable manner with respect to the spreading doctor 32. Such embodiments according to the invention are shown in FIGS. 7 to 9.

Figure 7:
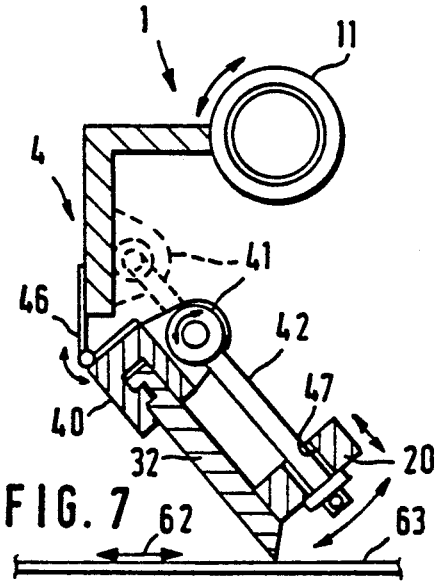

According to FIG. 7 each segment 20 is held so as to pivot about an axis parallel to the longitudinal axis of the apparatus 1 by a swivel arm 42 arranged thereon by means of a swivel bearing 41. The swivel bearing 41 is located on a holding part 40 for the spreading doctor 32. The holding part 40 is articulated by means of a swivel mounting in the form of a hinge bearing 46 to a holder 4 of the apparatus. This ensures that the setting angle of the spreading doctor 32 with respect to the material web 63 can be varied by adjusting the height of the holder 4. This is brought about by means of a swivel bearing 11 of the application apparatus 1 articulating the holder 4. It is possible in the described embodiment to arrange each swivel bearing 41 of a segment 20 directly on the holder 4, as shown in broken line form in FIG. 7. The swivel arm 42 can be connected to the segment 20 by means of a clearance fit 47.

Figure 8:
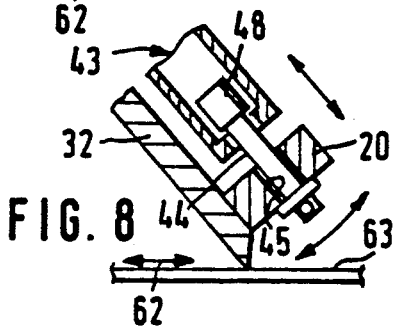

In a further development shown in FIG. 8, the swivel bearing 41 according to FIG. 7 can be replaced by a pivot bearing 43 with which the segment 20 is movably held by means of a pivot 44 connected thereto in loose or clearance fit 45 against an axial head 48.

FIG. 9 shows a further mounting of the pressing elements 20 independently of the mounting of a blade coating doctor 32. The latter is held in bending elastic manner on the holder 4, which is provided in the vicinity of the doctor blade with a clearance fit 45, which is positioned on the side remote from the substrate path 62. The clearance fit 45 keeps each segment 20 transversely movable and with free engagement with respect to the doctor 32.

Figure 10:
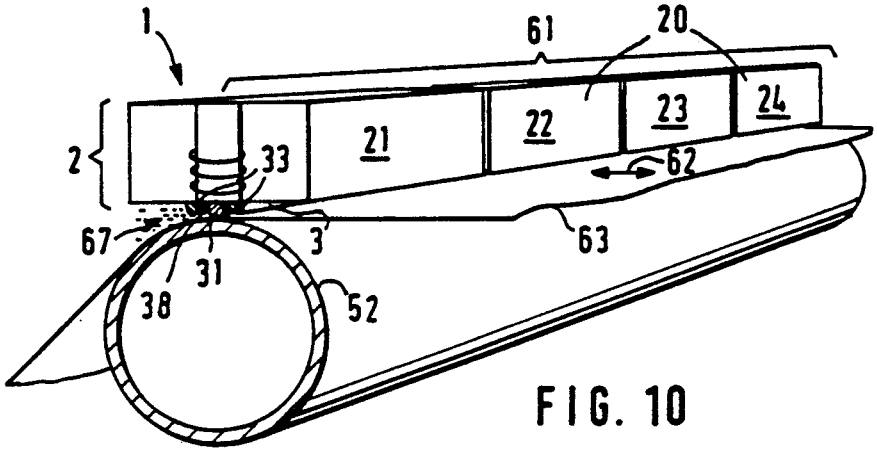
FIGS. 10 and 11 are a perspective view and a cross-section view of application apparatuses according to the invention with a segmented electromagnet pressing device.

FIGS. 7 to 9 illustrate the mobility of the individual elements by arrows. FIG. 10 shows an embodiment of the invention for a pressing device 2, which is subdivided over the application width 61 into segments 21 to 24 forming electromagnets.

Thus, the pressing device 2 is constructed as a magnetic beam segmented over the application width 61. On the sides of the magnetic beam portions 21 to 24 facing the substrate path 62 is arranged a round squeegee device 31 to spread substance 67, e.g. by means of a groove 38 in a throug bending elastic profile 33 and it can also be provided in the receptacle of the profile as a freely movable roll doctor (metering rod). The segmented magnetic beam pressing device 2 extends along a magnetizable material roller 52 forming the application countermember 5. It can be seen that the pressing device with the series-arranged magnet bodies can be subsequently fitted in a technically and economically advantageous manner in existing, steel roller-incorporating installations, e.g. for paper or cardboard manufacture for the purpose of finishing such substrates.

Figure 11:
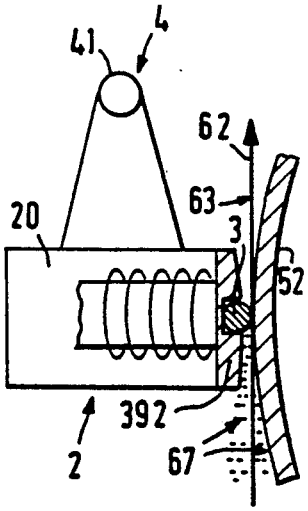

A segmented magnetic beam pressing device according to the invention is not limited to horizontally guided substrates 63. Thus, pivotably suspended or held magnetic beam portions as segments 20 according to FIG. 11 can be arranged with individual transverse mobility against a substrate web 62 vertically guided on a roller 52. In FIG. 11 the radius of roller 52 is so large that the roller has a coating doctor function with wedge-shaped space for substance 67 against the substrate web 63. Thus, the latter can also be coated on both sides. A round or roll doctor 3 is arranged in a recess of a pressure-elastic strip 392 arranged on the segments 20.

Figure 12:
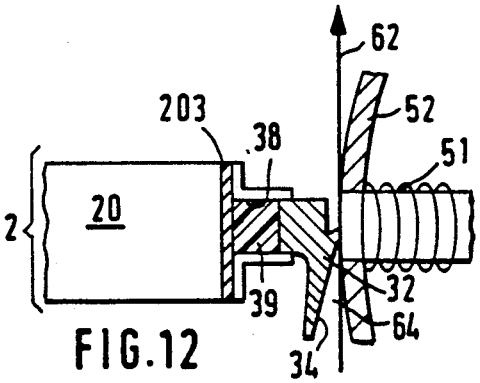
FIGS. 12 and 13 are cross-sectional views taken in a plane between adjacent segments in the application width arrangements of a pressing device with differently constructed pressing parts in application apparatuses according to the invention.
Figure 13:
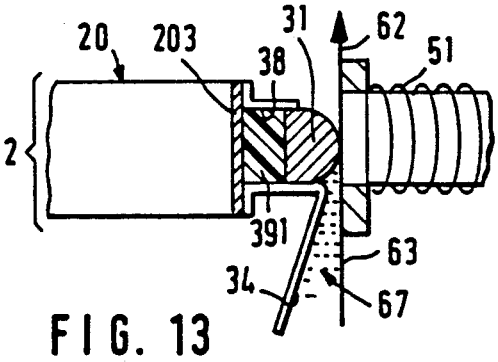

As shown in FIGS. 12 and 13 a blade or round profile of a pressing part 3 is held by means of a groove 38 on the side of the substrate path 62 on segments 20 and their connecting web 203 can be arranged in clamping connection combined with a bending elastic strip 39 extending over the application width. According to FIG. 12 a coating doctor 32 can be constructed in one piece with a predoctor or dosing profile 34 extending in bending elastic manner over the application width for forming a substrate accumulation space 64.

FIG. 13 shows a round doctor or squeegee device 31 on a groove 38 arranged by means of groove and tongue fixing, a bending elastic wall part 391 of the groove 38 being constructed as a predoctor/dosing profile 34 extending over the application width.

According to FIGS. 12 and 13 the countermembers 5 of the application apparatus 1 are provided as magnetic beams 51 extending over the application width. The segments 20 of the pressing device 2 can be constructed as magnetizable bodies or as permanentmagnets/electromagnets, the latter being arranged in antipole manner with respect to the magnetic beam 51. The application apparatuses according to FIGS. 12 and 13 operate against vertically guided substrate webs 63.

Figure 14:
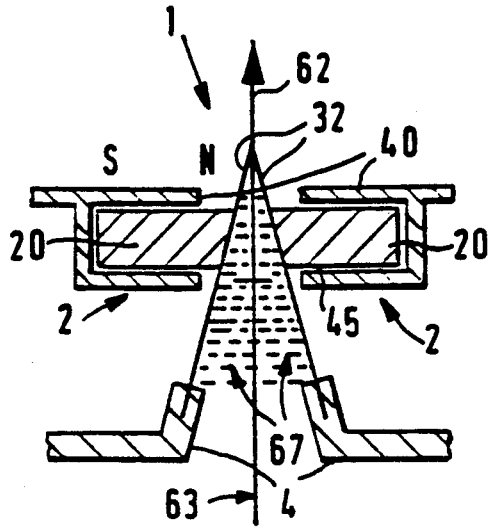
FIGS. 14 to 16 are cross-sectional views of application apparatuses according to the invention with segment pressing devices arranged in alternating manner to the substrate path.

FIG. 14 shows an application apparatus 1 with a pressing device 2 arranged on either side of the substrate path 62 for the two-sided application substance 67 to a substrate web 63. The pressing devices 2 are arranged and constructed symmetrically to the substrate path 62 or to the substrate web 63. Pressing parts 3 constructed as blade-like coating doctors 32 mounted on holder 4 form a wedge-shaped substance area through which the substrate web 63 is centrally passed. The coating doctors 32 are movable in the direction of the substrate web 63 by means of the alternately arranged pressing devices 2 engaging loosely thereon. The pressing devices 2 are in each case displaceably mounted in a holding part 40 having a clearance fit 45. Mounting corresponds to that of the embodiment of FIG. 9.

Each pressing device 2 comprises a row of segments 20 arranged over the application width and which are in each case in the form of permanent magnets. The magnetic polarity of the alternately facing permanent magnet segments on the substrate path 62 is such that they mutually magnetically attract. The permanent magnet segments can be replaced by electromagnet segments. A pair of mutually attracting segments can, according to a further embodiment, comprise on one side of the substrate path 62 a magnet and on the other side a body made from magnetizable, magnetically attractable material. In the application apparatus 1 according to FIG. 14 the doctor holders 4 are arranged independently and separately of holding parts 40 for the segments 20.

An application apparatus 1 according to FIG. 15, like that of FIG. 14, comprises two alternately arranged pressing devices 2 on a substrate path 62 and having in each case segments 20, which loosely engage on the blade coating doctors 32 and form magnetic segment pressing pairs. In FIG. 15 the coating doctors 32 and clearance fit 45 are provided on a common holder 4, which is pivotable about an axis parallel to the longitudinal direction of the apparatus 1 by means of a bearing 11. The segmented pressing device 2 with coating doctors 3 and holder 4 can in each case be located within a round stencil 66 rotating in direction 65.

Figure 16:
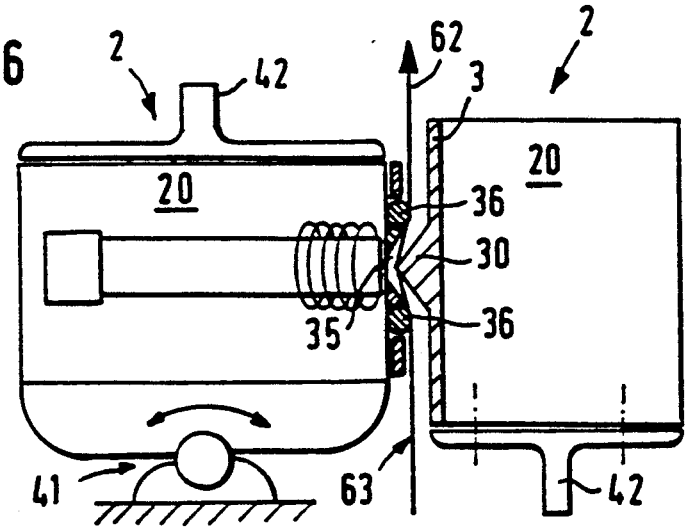

An application apparatus 1 according to FIG. 16, like that of FIG. 11, comprises on one side of the substrate path 62 a pressing device 2 with juxtaposed electromagnet segments 20 arranged along the application width and which are in each case pivotably articulated by means of an arm 42 or a swivel bearing 41. On the other side of the substrate path 62 is also provided a pressing device 2 according to the invention, which comprises juxtaposed segments 20 over the application width and which are in each case made from magnetizable material or a permanent magnet. Each of these segments 20 can be movably held e.g. by means of an arm 42 in the direction 65 of the substrate path 62 and/or at right angles thereto.

The application apparatus 1 according to FIG. 16 comprises an air knife arrangement on the substrate path 62. Segments 20 are held by swivel bearings 41 and arms 42. Two through bending elastic pressing parts 36 are arranged along the application width on the segmented electromagnet pressing device 2 and leave between them a recess 35. In the latter web 63 is engaged by an air knife 30 with a pointed or round working edge. The air knife 30 is arranged on the other segmented pressing device 2 as a bending elastic pressing part 3 extending over the application width. In FIG. 16 one of the two pressing devices 2 can be replaced by a magnetizable countermember 5, which then has a doctor recess and squeegee device constructed according to FIG. 16.

According to FIG. 17 an application apparatus 1 comprises a pressing device 2 optionally arranged in a round stencil 66 rotating in direction 65 with juxtaposed segments 20 in the application width. As in the embodiment according to FIG. 9, the segments are displaceably held in a clearance fit 45 in the direction of the substrate path 62 and loosely engage on a blade coating doctor 32 forming the pressing part 3. The doctor and the clearance fit 45 are arranged on a common holder 4, which is pivotable about an axis parallel to the longitudinal direction of the apparatus 1 by means of a bearing 11. On the other side of the substrate path 62 is provided a pressing face of a countermember 5 extending over the application width and against which functions the doctor 32 under the action of a magnetic force between the countermember 5 and the segments 20. Segments 20 are in particular constructed as permanent magnets, whilst the countermember is made from magnetizable material. The latter can optionally be movably articulated by means of a holder 53 in the direction of the substrate path 62 and/or transversely thereto.

While a preferred embodiment has been set forth along with modifications and variations to show specific advantageous details of the present invention, further embodiments, modifications and variations are contemplated within the broader aspects of the present invention, all as set forth by the spirit and scope of the following claims.

I claim:

1. A doctor apparatus for the application of fluent material to a substrate over an application width with a doctor body, comprising:

a pressing part forming the doctor body and corresponding in length to the application width for engaging a substrate along a substrate path;

a pressing device for pressing the pressing part, said pressing device being lengthwise subdivided into segments;

the pressing part being constructed in bending elastic manner over its length and supported over its length by a plurality of the segments along a side of each of said plurality of segments facing the substrate path;

means for linking the segments together in a link-like manner only along said sides of each of said plurality of segments facing the substrate path;

said pressing device pressing said pressing part toward the substrate path in a pressing direction; and means for loosely holding the segments to permit relative movement of the segments both in the pressing direction and transverse to the substrate path.

2. Apparatus according to claim 1, wherein the segments of the pressing device are in the form of mass parts constituting weights.

3. Apparatus according to claim 1, wherein the segments of the pressing device are constructed with means for pressing with magnetic force.

4. Apparatus according to claim 3, including a magnetic beam forming a countermember on the opposite side of the substrate path from the segments.

5. Apparatus according to claim 3, including a magnetic roller forming a counter-member.

6. Apparatus according to claim 3, wherein a said doctor apparatus is provided on each side of the substrate path, and including magnetic means biasing each doctor apparatus toward the substrate path.

7. Apparatus according to claim 1, wherein the pressing part is constructed as a rod-like profile doctor.

8. Apparatus according to claim 1, wherein the pressing part is constructed as a magnetizable roll doctor freely rotatably held in at least one of the plurality of segments.

9. Apparatus according to claim 1, wherein the segments are juxtaposed along the application width.

10. Apparatus according to claim 9, wherein the pressing device is a one-piece strip formed in comb-like manner with slots defining the segments therebetween.

11. Apparatus according to claim 10, wherein a slot-free portion of the profile strip forms the pressing part.

12. Apparatus according to claim 9, wherein each segment is constructed as a separate one-piece body.

13. Apparatus according to claim 12, wherein the pressing part is constructed as an undivided coating doctor blade over the application width, and each of the plurality of the segments rests loosely on the coating doctor blade and is movable with respect thereto.

14. Apparatus according to claim 13, including a swivel bearing articulating the coating doctor blade.

15. Apparatus according to claim 13, wherein each of the segments is provided with a recess freely and movably receiving the coating doctor blade.

16. Apparatus according to claim 1, wherein the pressing part is removably connected to at least one of the segments.

17. Apparatus according to claim 1, including, a holder for the segments, and at least one bearing for articulating the holder to be movable transverse to the application width.

18. A doctor apparatus for the application of fluent material to a substrate over an application width with a doctor body, comprising:

a pressing part forming the doctor body and corresponding in length to the application width for engaging a substrate along a substrate path;

a pressing device for pressing the pressing part, said pressing device being lengthwise subdivided into segments;

the pressing part being constructed in bending elastic manner over its length and supported over its length by at least one of the segments along a side of the at least one segment facing the substrate path;

means for linking the segments together in a link-like manner, wherein said linking means includes a bending elastic strip arranged between the segment and the pressing part;

the pressing part being separate from the pressing device; and said pressing device pressing said pressing part toward the substrate path.

19. Apparatus according to claim 18, characterized in that the pressing part includes a profile surface means for predoctoring that faces the substrate path.

20. Apparatus according to claim 18, wherein the pressing part is constructed as a magnetizable roll doctor freely rotatably held in the elastic strip.

21. A doctor apparatus for the application of fluent material to a substrate over an application width with a doctor body, comprising:

a pressing part forming the doctor body and corresponding in length to the application width for engaging a substrate along a substrate path;

a pressing device for pressing the pressing part, said pressing device being lengthwise subdivided into segments, wherein at least one segment has a recess along the application width with edges forming two parallel pressing parts;

the pressing part forming the doctor body being constructed in bending elastic manner over its length and supported over its length by at least one of the segments along a side of the at least one segment facing the substrate path;

means for linking the segments together in a link-like manner;

the pressing part forming the doctor body being separate from the pressing device; and said pressing device pressing said pressing part toward the substrate path.

22. A doctor apparatus for the application of fluent material to a substrate over an application width with a doctor body, comprising:

a pressing part forming the doctor body and corresponding in length to the application width for engaging a substrate along a substrate path;

a pressing device for pressing the pressing part, said pressing device being lengthwise subdivided into segments, wherein the segments are superimposed transversely to the application width;

the pressing part being constructed in bending elastic manner over its length and supported over its length by at least one of the segments along a side of the at least one segment facing the substrate path;

means for linking the segments together in a link-like manner;

the pressing part being separate from the pressing device; and said pressing device pressing said pressing part toward the substrate path.

23. Apparatus according to claim 22, wherein the pressing device includes a frame in which the segments are movably supported.

24. Apparatus according to claim 23, including a swivel bearing arranged in the center of the application width on the frame for swiveling the segments relative to the substrate path.

25. A doctor apparatus for the application of fluent material to a substrate over an application width with a doctor body, comprising:

a pressing part forming the doctor body and corresponding in length to the application width for engaging a substrate along a substrate path;

a pressing device for pressing the pressing part, said pressing device being lengthwise subdivided into segments, wherein the segments are juxtaposed along the application width;

the pressing part being constructed in bending elastic manner over its length and supported over its length by at least one of the segments along a side of the at least one segment facting the substrate path;

means for linking the segments together in a link-like manner;

the pressing part being separate from the pressing device;

said pressing device pressing said pressing part toward the substrate path; and a holder on which each of the segments is articulated to be movable transversely to the application width.

26. Apparatus according to claim 25, wherein the holder has a clearance fit in which each segment is movably held.

27. Apparatus according to claim 25, wherein the holder includes a swivel bearing a swivel arm through which each segment is articulated.

28. Apparatus according to claim 27, wherein the holder has a clearance fit in which each segment is movably held.

29. Apparatus according to claim 25, wherein the holder includes a pivot bearing through which each segment is articulated about a pivot axis extending therethrough.

30. Apparatus according to claim 29, wherein the holder has a clearance fit in which each segment is movably held.

* * * * *